US006780076B2

(12) United States Patent
Horchler et al.

(10) Patent No.: US 6,780,076 B2
(45) **Date of Patent: *Aug. 24, 2004**

(54) TALKING STICK HORSE

(75) Inventors: Jack Horchler, Mokena, IL (US); Damian Mucaro, Wayne, NJ (US); Kevin Lai, Hong Kong (HK)

(73) Assignee: Tek Nek Toys International, Inc., Mokena, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/331,836

(22) Filed: Dec. 30, 2002

(65) Prior Publication Data

US 2003/0092348 A1 May 15, 2003

Related U.S. Application Data

(63) Continuation of application No. 09/968,069, filed on Oct. 1, 2001, now Pat. No. 6,524,156.

(51) Int. Cl.[7] ..... A63H 33/00
(52) U.S. Cl. ..... 446/29; 472/98; 446/301
(58) Field of Search ..... 446/29, 98, 301, 446/313, 331, 369, 397, 408, 411; 434/322; 280/1.13, 1.14; 472/95–98

(56) References Cited

U.S. PATENT DOCUMENTS

| | | | | |
|---|---|---|---|---|
| 953,755 | A | 4/1910 | Nidermaier | |
| 2,840,377 | A | 6/1958 | Jenks | |
| 3,201,117 | A | 8/1965 | Gursha | |
| 3,682,474 | A | 8/1972 | Campbell | |
| 4,808,142 | A | 2/1989 | Berliner | 446/301 |
| 5,074,820 | A | 12/1991 | Nakayama | 446/29 |
| 5,100,362 | A | 3/1992 | Fogarty et al. | 446/272 |
| 5,145,447 | A | 9/1992 | Goldfarb | 446/408 |
| 5,279,514 | A | 1/1994 | Lacombe et al. | 446/297 |
| 5,316,515 | A | 5/1994 | Hyman et al. | 446/28 |
| 5,795,213 | A | 8/1998 | Goodwin | |
| 5,823,847 | A | 10/1998 | Gellman | 446/301 |
| 5,944,533 | A | 8/1999 | Wood | 434/322 |
| 6,315,631 | B1 | 11/2001 | Beckman et al. | 446/297 |

*Primary Examiner*—Derris H. Banks
*Assistant Examiner*—Jamila Williams
(74) *Attorney, Agent, or Firm*—Seyfarth Shaw

(57) ABSTRACT

An interactive ride-on toy, having a stuffed toy horse's head which includes ears, a movable mouth and is connected to a stick. One or more buttons, each with an icon depicting an image, is positioned on one or both ears of the horse's head. An electronically programmed chip responds to activation of the button to operate a speaker and a mechanism for moving the horse's mouth, the speaker playing sounds relating to the image depicted on each button.

20 Claims, 5 Drawing Sheets

TALKING STICK HORSE

This is a continuation of patent application Ser. No. 09/968,069, filed Oct. 1, 2001, now U.S. Pat. No. 6,524,156, issued Feb. 25, 2003.

FIELD OF THE INVENTION

The present invention relates to interactive toys for children that talk and sing, and in particular, to interactive ride-on toys such as stick horses.

BACKGROUND OF THE INVENTION

Ride-on toys, such as stick horses, are well known in the art and allow the child to pretend that he or she is riding an actual horse. Stick horses typically comprise a toy resembling a horse's head connected to one end of a rigid stick. The child "rides" the stick horse by straddling the stick while holding the head portion.

Stick horses and similar toys are useful for enhancing a child's motor skills, and developing the child's imagination. However, such toys have limited play value because they are essentially static. Thus, there is a need for stick horse or similar ride-on toy that can interact with a child to encourage creative play and add teaching value to the toy.

SUMMARY OF THE INVENTION

These needs and other needs are satisfied by the interactive ride-on toy of the present invention, comprising a stuffed toy animal's head connected to a riding member, such as a stick. The head includes a movable mouth, a nose, eyes and ears. At least one button is positioned on at least one ear, the button having an icon depicting an image. In a preferred embodiment, one ear contains two buttons and the other ear contains a single button. An electronically programmed chip responds to activation of the ear button(s) to operate a speaker to produce sounds relating to the image and to operate a mechanism for moving the mouth. Electrical power is supplied by a battery located in a compartment provided, e.g., in the back of the head, such as within the mane of the horse or pony. Where the riding member is a stick, it may comprise two or more parts to facilitate packaging. Where the animal is a play horse or pony, a mane of simulated horse hair is provided, together with a comb for combing the horse's or pony's mane.

DETAILED DESCRIPTION OF THE INVENTION

Figure 1:
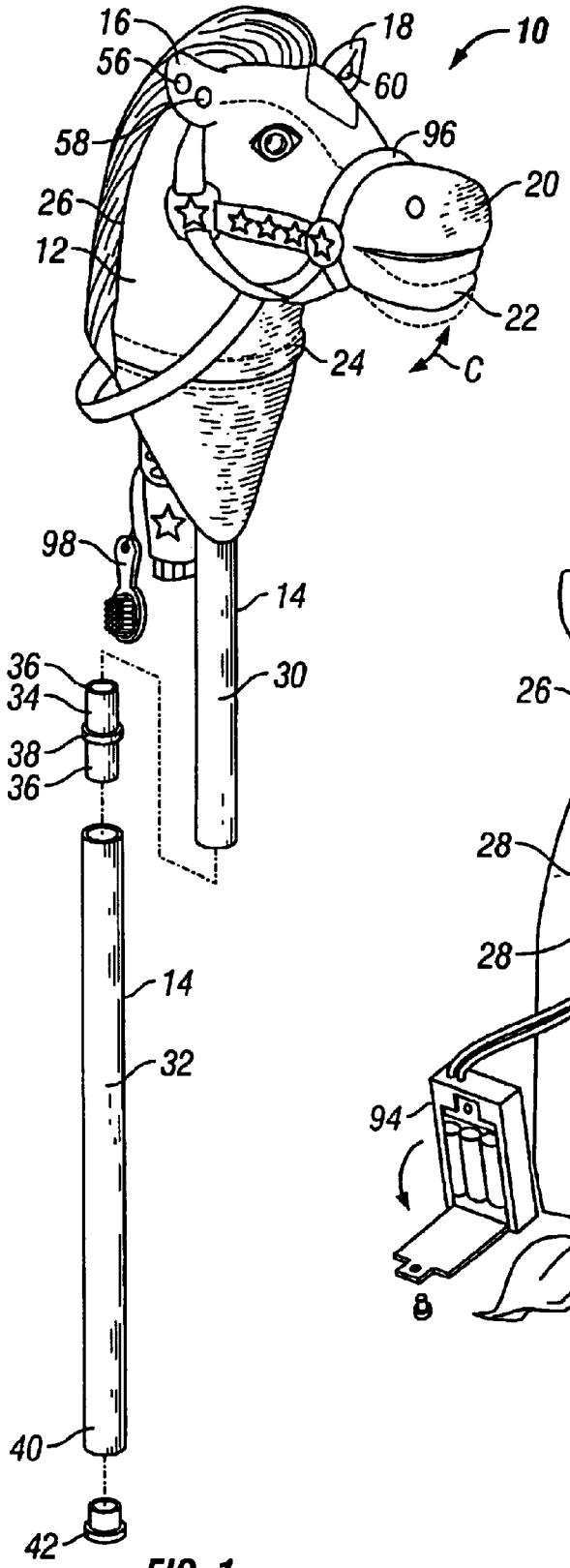
FIG. 1 is an exploded front perspective view of one embodiment of the present invention.
Figure 2:
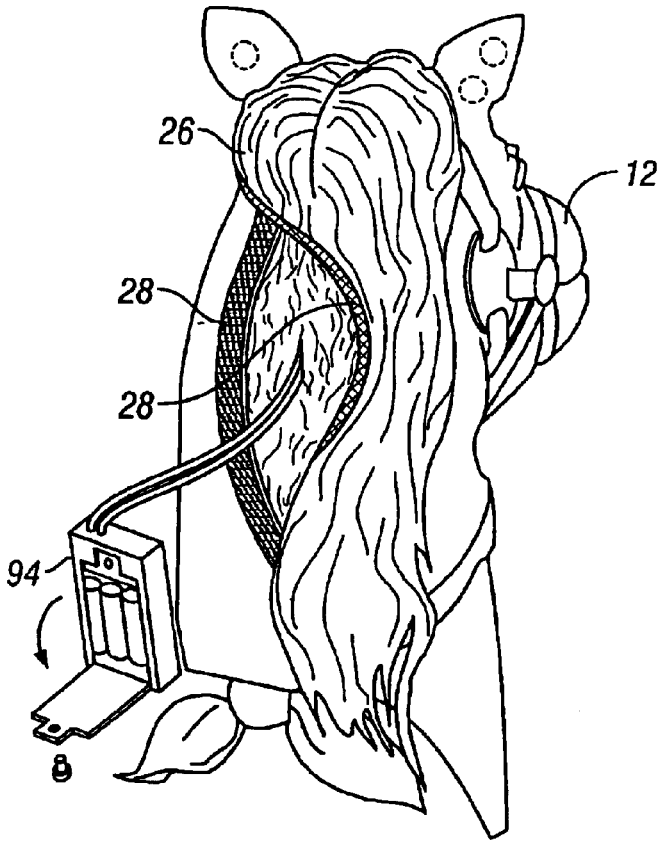
FIG. 2 is a partial rear perspective view of the head portion of the embodiment of FIG. 1, showing the battery compartment and battery.

In accordance with the present invention, an interactive stick horse or pony 10 is described, comprising a toy resembling a horse's head 12 that is connected to a riding member, such as a stick 14. As shown in FIG. 1, horse's head 12 is a stuffed toy, with left and right ears 16, 18, a movable mouth with upper and lower mouth portions 20, 22, and a rigid base 24. As shown in FIG. 2, a mane 26 conceals a closure 28 for accessing the interior of horse's head 12. In a preferred embodiment, closure 28 is a velcro strip.

Stick 14 is a two-piece hollow cylinder comprised of a short upper tube 30 and a longer lower tube 32. To facilitate packaging of stick horse 10, lower tube 22 has roughly the same length as height of upper tube 20 plus horse's head 12. Stick 14 is assembled from upper and lower tubes 30, 32 of by means of a connector 34, which consists of a pair of sleeves 36 positioned on either side of a spacer 38. Sleeves 36 are sized and shaped to fit within the inner circumference of upper and lower tubes 30, 32, and hold the two tubes together by friction.

As shown in FIG. 1, the bottom end 40 of lower tube 32 is provided with a friction fit cap 42. The top end 46 of upper tube 30 is connected to base 24 of horse's head 12. Base 24 is provided with a cylindrical collar 44 that has an inner circumference sized and shaped to receive top end 46 of upper tube 30. To secure upper tube 30 to collar 44, complementary openings 48, 50 are provided in top end 46 of upper tube 30 and in collar 44, respectively. Rivets 52 are inserted through both openings 48, 50 to fasten upper tube 30 to collar 44. As shown in FIG. 1, a decorative scarf 54 is attached to the base of horse's head 12 to conceal the connection between upper tube 30 and base 24.

Figure 4:
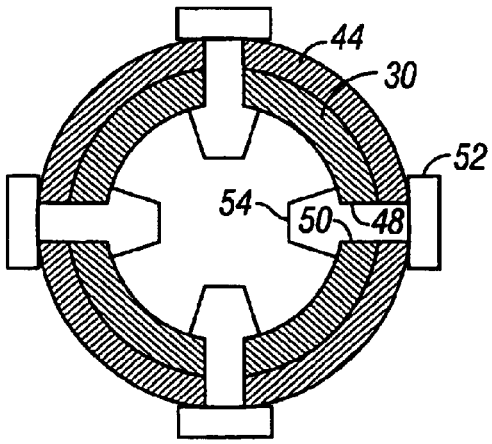
FIG. 4 is a section view taken along lines 4—4 of FIG. 3.

It is preferred to construct stick 14 and base 24 of a durable, lightweight material, such as plastic. As shown in FIG. 4, rivets 52 are similarly made of plastic and are provided with slotted, tapered ends 54, that may be compressed to permit rivets 52 to inserted through openings 48, 50. Once end 54 passes completely through openings 48, 50, end 54 expands to its original shape to hold rivet 52 in place and lock upper tube 30 to collar 44.

As shown in FIG. 1, left and right ears 16, 18 are provided with buttons 56, 58, 60, which mark the position of switches 56*a*, 58*a*, 60*a* (shown in FIG. 7) concealed within the ears. Depressing or squeezing buttons 56, 58, 60 activates the corresponding switches 56*a*, 58*a*, 60*a*, which causes a speaker 62 concealed within horse's head 12 to play a song, speak a phrase or make other sounds. In a preferred embodiment, buttons 56, 58, 60 are cloth patches embroidered with different icons depicting various images, such as a horse, a musical note or other design that relates to the sounds produced by activating that button.

For example, button 56 may have an icon depicting a horse's head and may be activated to play a short phrase, such as "let's go for a ride." Activating button 56 a second time may produce an alternate phrase, such as "I like it when you brush me." Button 58 may have an icon depicting a whole horse and may be activated to play the sound of a horse's neigh or galloping sounds. Button 60 may have an icon depicting a musical note and may be activated to play a song.

Figure 3:
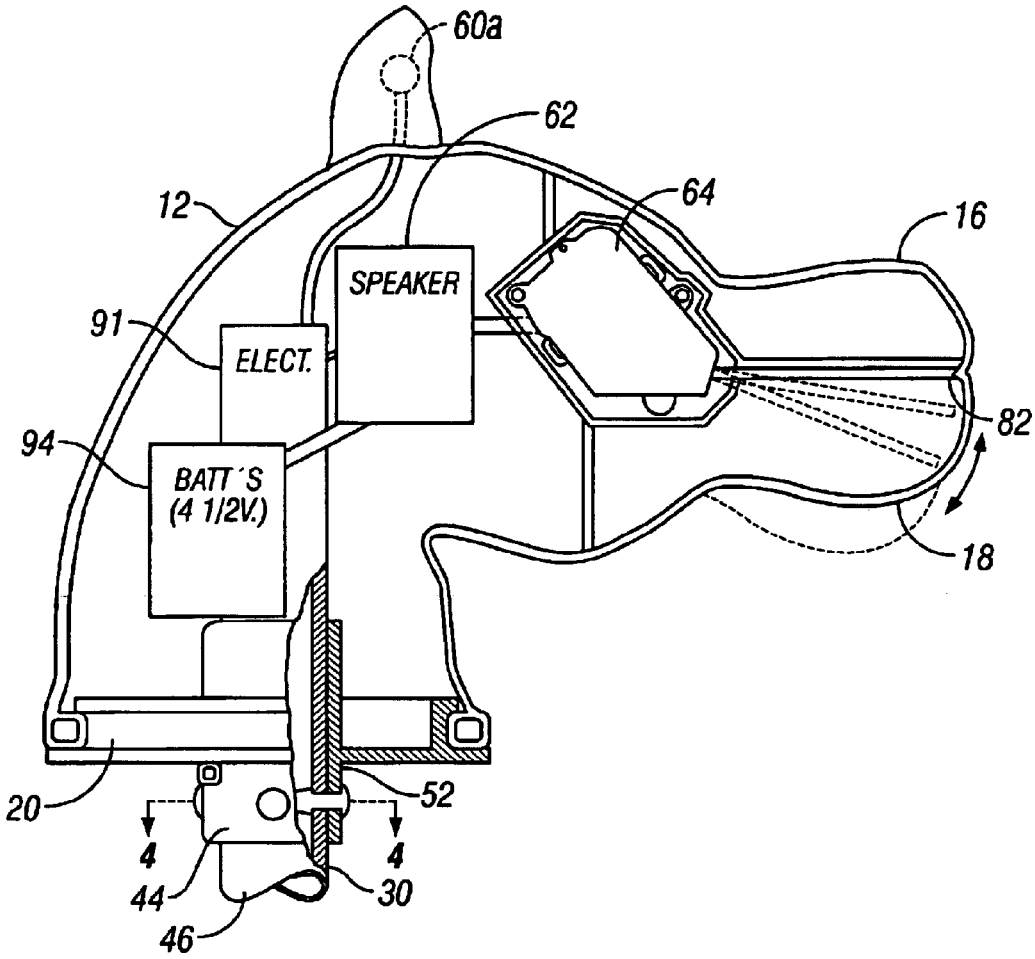
FIG. 3 is a side section view of the head portion of the embodiment of FIG. 1, schematically showing the electrical and mechanical parts.
Figure 5:
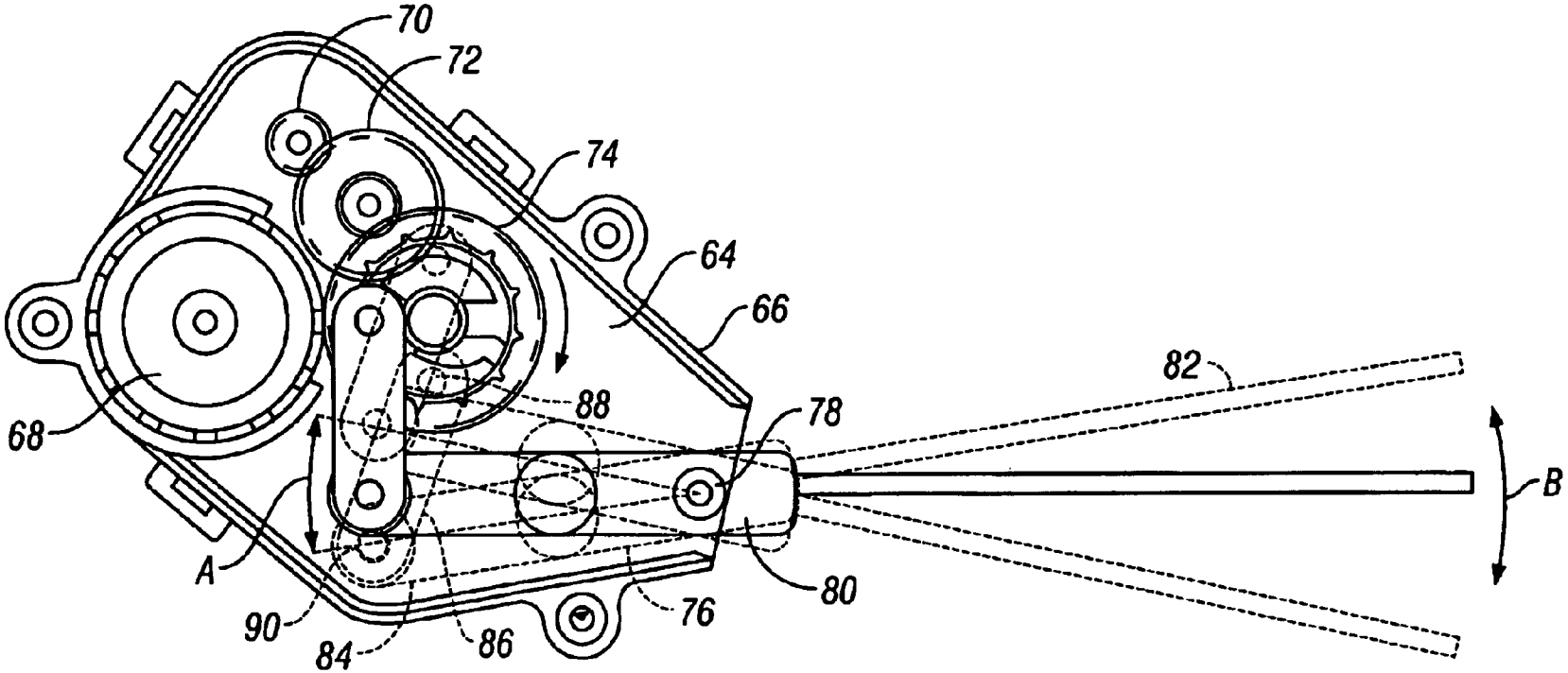
FIG. 5 is a side section view of the mouth operating mechanism of the embodiment of FIG. 1.
Figure 6:
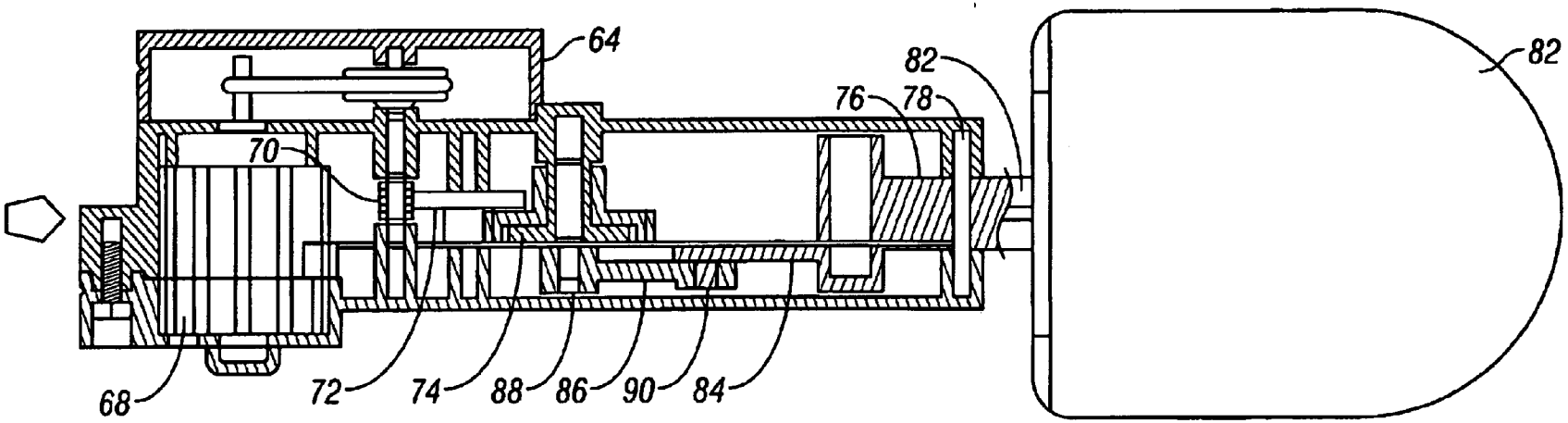
FIG. 6 is a top section view of the mechanism shown in FIG. 5.

In addition to playing sounds, the activation of buttons 56, 58, 60 also causes the horse's mouth to move while the sounds are being played. As shown in FIGS. 3, 5 and 6, horse's head 12 contains a gear box 64, that controls the up and down movement of lower mouth portion 22. Gear box 64 comprises a housing 66, which contains a motor 68 that drives a series of gears 70, 72, 74. An arm 76 is pivotally connected to gear box 64 at pivot 78. End 80 of arm 76 extends beyond gear box 64 and is connected to a plate 82, which is sized and shaped to fit within lower mouth portion 22. Opposite end 84 of arm 76 is connected to gear 74 through a push rod 86, which is pivotally connected to gear 74 at pivot 88 and arm 76 at pivot 90.

As shown in FIG. 5, the operation of motor 68 causes the rotation of gear 74, which raises and lowers push rod 86. The movement of push rod 86 raises and lowers end 84 of arm 76, causing arm 76 to rotate on pivot 78 through a short arc A. The rotation of arm 76 causes the up and down movement of plate 82 through an arc B, which results in the opening and closing movement of lower mouth portion 22 as shown by arrow C in FIGS. 1 and 3.

Figure 7:
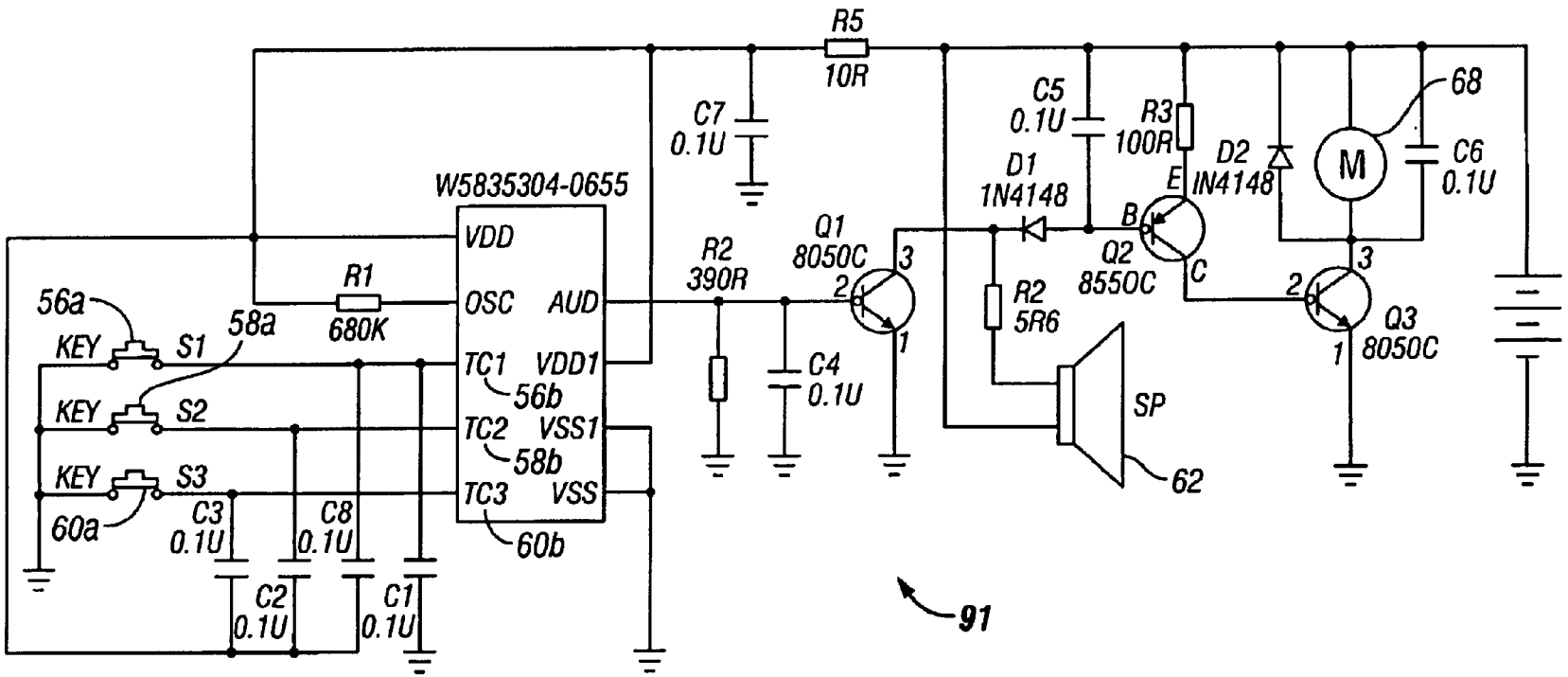
FIG. 7 is a circuit diagram of the control system of the embodiment of FIG. 1.

FIG. 7 depicts a general circuit diagram of the control system 91 of the present invention. The operation of the speaker 62 and gear box 64 is controlled by an electronically programmed chip 92 contained within horse's head 12, such as a W583 speech synthesizer chip (Winbond Electronics Corp., Taiwan). Depressing or squeezing buttons 56, 58, 60 actuates switches 56*a*, 58*a*, 60*a*, which send a signal to the corresponding trigger inputs 56*b*, 58*b*, 60*b*, directing chip 92 to actuate speaker 62 to play a preprogrammed sound or operate gear box motor 68 to move lower mouth portion 22.

A power supply of 4.5 V, 3 AA sized batteries, is required for operation of chip 92, speaker 62 and motor 68. As shown in FIG. 2, the batteries are stored in a battery compartment 94 concealed beneath mane 26 of horse's head 12, such that battery compartment 94 is readily accessible through closure 28, which may be a hook and loop fastener (such as Velcro), snaps, a zipper, or other suitable fastening closure means.

Although it is preferred that horse's head 12 is a stuffed toy, it will be understood by those of skill in the art that horse's head 12 may also be made of a rigid material, such as wood or plastic, having a hollow interior to accommodate the speaker, gear box, control system and batteries described above. The stick horse 10 may also be provided with various accessories to enhance interactive play, such as a bridle 96 and brush 98 (FIG. 1).

In addition to the stick horse 10 described above, the present invention is readily applied to rocking horses, spring horses, and other ride-on toys.

It will be apparent to those skilled in the art that changes and modifications may be made in the embodiments illustrated herein, without departing from the spirit and the scope of the invention. Thus, the invention is not to be limited to the particular forms herein shown and described except insofar as indicated by the scope of the appended claims.

What is claimed is:

1. An interactive rocking horse, comprising:

a rocking horse having a button and a head including upper and lower members;

a speaker and a mechanism for moving the upper and lower members located within the head; and an electronically programmed chip for operating both the speaker and the mechanism in response to activation of the button.

2. The interactive rocking horse of claim 1, wherein at least one of the upper and lower members includes a chin.

3. The interactive rocking horse of claim 1, wherein at least one of the upper and lower members includes a nose.

4. The interactive rocking horse of claim 1, wherein the mechanism operates to move at least one of the upper and lower members.

5. The interactive rocking horse of claim 1, wherein the button is located on the head.

6. The interactive rocking horse of claim 1, wherein the upper member includes a nose, the lower member includes a chin, the mechanism operates to move at least one of the nose and the chin, and the button is located on the head.

7. An interactive spring horse, comprising:

a spring horse having a button and a head including upper and lower members;

a speaker and a mechanism for moving the upper and lower members located within the head; and a electronically programmed chip for operating both the speaker and the mechanism in response to activation of the button.

8. The interactive spring horse of claim 7, wherein at least one of the upper and lower members includes a chin.

9. The interactive spring horse of claim 7, wherein at least one of the upper and lower members includes a nose.

10. The interactive spring horse of claim 7, wherein the mechanism operates to move at least one of the upper and lower members.

11. The interactive spring horse of claim 7, wherein the button is located on the head.

12. The interactive rocking spring horse of claim 7, wherein the upper member includes a nose, the lower member includes a chin, the mechanism operates to move at least one of the nose and the chin, and the button is located on the head.

13. An interactive ride-on toy, comprising:

a toy animal's head having a movable mouth;

a riding member connected to the head;

at least one button;

a speaker and a mechanism for moving the mouth located within the head, and an electronically programmed chip for operating both the speaker and the mechanism in response to activation of the button.

14. The interactive ride-on toy of claim 13, wherein the mouth includes upper and lower portions.

15. The interactive ride-on toy of claim 14, wherein the mechanism operates to move at least one of the upper and lower portions.

16. The interactive ride-on toy of claim 14, wherein the upper member includes a nose, the lower member includes a chin, the mechanism operates to move at least one of the nose and the chin, and the button is located on the head.

17. An interactive ride-on toy, comprising:

a toy animal's head including upper and lower members;

a button;

a speaker and a mechanism for moving the upper and lower members; and an electronically programmed chip for operating both the speaker and the mechanism in response to activation of the button.

18. The interactive ride-on toy of claim 17, wherein at least one of the upper and lower members includes a chin.

19. The interactive ride-on toy of claim 17, wherein at least one of the upper and lower members includes a nose.

20. The interactive ride-on toy of claim 17, wherein the upper member includes a nose, the lower member includes a chin, the mechanism operates to move at least one of the nose and the chin, and the button is located on the head.

* * * * *

US006780076C1

(12) EX PARTE REEXAMINATION CERTIFICATE (9025th)

United States Patent

Horchler et al.

(10) Number: US 6,780,076 C1

(45) Certificate Issued: *May 22, 2012

(54) TALKING STICK HORSE

(75) Inventors: Jack Horchler, Mokena, IL (US); Damian Mucaro, Wayne, NJ (US); Kevin Lai, Hong Kong (HK)

(73) Assignee: Tek Nek Toys International, Inc., Southlake, TX (US)

Reexamination Request:
No. 90/009,891, Apr. 20, 2011

Reexamination Certificate for:

| | |
|---|---|
| Patent No.: | **6,780,076** |
| Issued: | **Aug. 24, 2004** |
| Appl. No.: | **10/331,836** |
| Filed: | **Dec. 30, 2002** |

( * ) Notice: This patent is subject to a terminal disclaimer.

Related U.S. Application Data

(63) Continuation of application No. 09/968,069, filed on Oct. 1, 2001, now Pat. No. 6,524,156.

(51) Int. Cl.
*A63H 33/00* (2006.01)

(52) U.S. Cl. ..... 446/29; 446/301; 472/98

(58) Field of Classification Search ..... None
See application file for complete search history.

(56) References Cited

To view the complete listing of prior art documents cited during the proceeding for Reexamination Control Number 90/009,891, please refer to the USPTO's public Patent Application Information Retrieval (PAIR) system under the Display References tab.

*Primary Examiner*—Glenn K. Dawson

(57) ABSTRACT

An interactive ride-on toy, having a stuffed toy horse's head which includes ears, a movable mouth and is connected to a stick. One or more buttons, each with an icon depicting an image, is positioned on one or both ears of the horse's head. An electronically programmed chip responds to activation of the button to operate a speaker and a mechanism for moving the horse's mouth, the speaker playing sounds relating to the image depicted on each button.

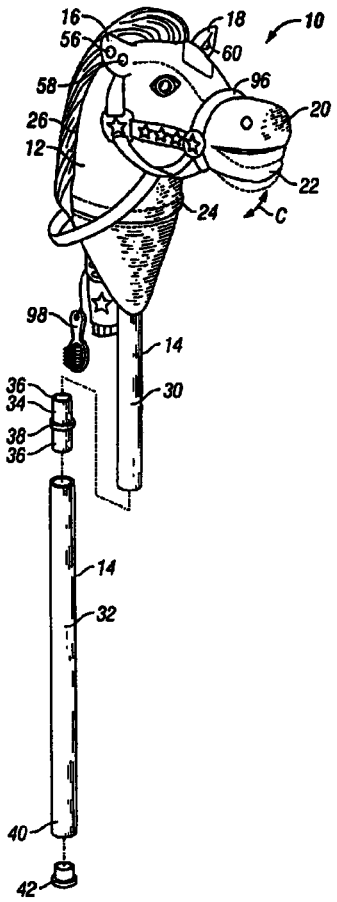

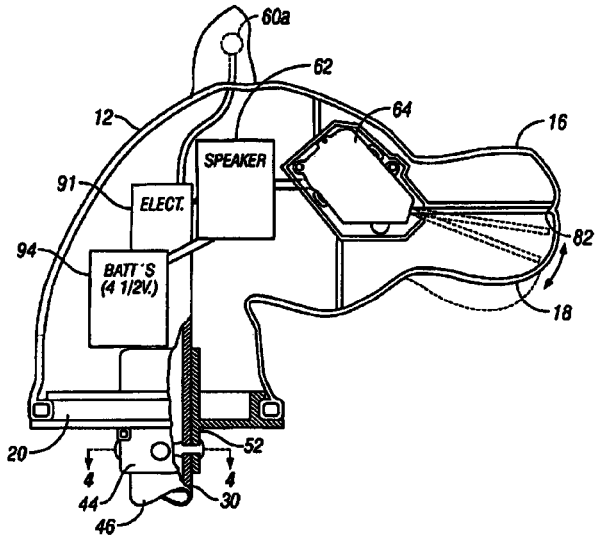

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 14 and 15 are cancelled.

Claims 1-4, 6-10, 12, 13 and 16-20 are determined to be patentable as amended.

Claims 5 and 11, dependent on an amended claim, are determined to be patentable.

1. An interactive rocking horse, comprising:

a rocking horse having a button and a *stuffed toy* head including *movable* upper and lower *mouth* members;

a speaker and a mechanism for moving the upper and lower *mouth* members located within the head*, said mechanism including a member extending only into the lower of the mouth members and moving in a generally up and down arc, the mechanism member configured to result in movement of the mouth member opened and closed caused by up and down arcuate movement of the mechanism member by the mechanism*; and an electronically programmed chip for operating both the speaker and the mechanism in response to activation of the button.

2. The interactive rocking horse of claim 1, wherein [at least one of the upper and] *the* lower [members] *mouth member* includes a chin.

3. The interactive rocking horse of claim 1, wherein [at least one of ] the upper [and lower members] *mouth member* includes a nose.

4. The interactive rocking horse of claim 1, wherein the mechanism operates to move at least one of the upper and lower *mouth* members *relative to the other*.

6. The interactive rocking horse of claim 1, wherein the upper *mouth* member includes a nose, the lower *mouth* member includes a chin, the mechanism operates to move at least one of the nose and the chin, and the button is located on the head.

7. An interactive spring horse, comprising:

a spring horse having a button and a *stuffed toy* head including *movable* upper and lower *mouth* members;

a speaker and a mechanism for moving the upper and lower *mouth*_members located within the head *said mechanism including a member extending only into the lower of the mouth members and moving in a generally up and down arc, the mechanism member configured to result in movement of the mouth member opened and closed caused by up and down arcutae movement of the mechanism member by the mechanism*; and a electronically programmed chip for operating both the speaker and the mechanism in response to activation of the button.

8. The interactive spring horse of claim 7, wherein [at least one of] *the* lower [members] *mouth member* includes a chin.

9. The interactive spring horse of claim 7, wherein [at least one of] the upper [and lower members] *mouth member* includes a nose.

10. The interactive spring horse of claim 7, wherein the mechanism operates to move at least one of upper and lower *mouth* members *relative to the other*.

12. The interactive [rocking] spring horse of claim 7, wherein the upper *mouth* member includes a nose, the lower *mouth* member includes a chin, the mechanism operates to move at least one of the nose and the chin, and the button is located on the head.

13. An interactive ride-on toy, comprising:

a *stuffed* toy animal's head having a movable mouth *including movable upper and lower portions*;

a riding member connected to the head;

at least one button;

a speaker and a mechanism for moving the mouth located within the head *wherein the mechanism operates to move at least one of the upper and lower portions, said mechanism including a member extending only into the lower of the mouth members and moving in a generally up and down arc, the mechanism member configured to result in movement of the mouth member opened and closed caused by up and down arcuate movement of the mechanism member by the mechanism*, and an electronically programmed chip for operating both the speaker and the mechanism in response to activation of the button.

16. The interactive ride-on toy of claim [14] *13*, wherein the upper [member] *portion* includes a nose, the lower [member] *portion* includes a chin, the mechanism operates to move at least one of the nose and the chin, and the button is located on the head.

17. An interactive ride-on toy, comprising:

a *stuffed* toy animal's head including *movable* upper and lower *mouth* members;

a button;

a speaker and a mechanism for moving the upper and lower *mouth* members; and an electronically programmed chip for operating both the speaker and the mechanism in response to activation of the button*, said mechanism including a member extending only into the lower of the mouth members and moving in a generally up and down arc, the mechanism member configured to result in movement of the mouth member opened and closed caused by up an down arcuate movement of the mechanism member by the mechanism*.

18. The interactive ride-on toy of claim 17, wherein [at least one of the upper and] *the* lower [members] *mouth member* includes a chin.

19. The interactive ride-on toy of claim 17, wherein [at least one of] the upper [and lower members] *mouth member* includes a nose.

20. The interactive ride-on toy of claim 17, wherein the upper *mouth* member includes a nose, the lower *mouth* member includes a chin, the mechanism operates to move at least one of the nose and the chin, and the button is located on the head.

* * * * *